United States Patent [19]

Ehrgott et al.

[11] 4,283,699

[45] Aug. 11, 1981

[54] HOLDER FOR AN ELECTROMAGNETIC COIL

[75] Inventors: Roland Ehrgott, Munich; Gerhard Meindl, Alling, both of Fed. Rep. of Germany

[73] Assignee: Siemens Aktiengesellschaft, Berlin & Munich, Fed. Rep. of Germany

[21] Appl. No.: 127,871

[22] Filed: Mar. 6, 1980

[51] Int. Cl.[3] ..... H01F 15/02; H01F 27/26

[52] U.S. Cl. ..... 336/67; 336/210

[58] Field of Search ..... 336/210, 212, 65, 67, 336/68, 98; 310/218

[56] References Cited

U.S. PATENT DOCUMENTS

| | | | |
|---|---|---|---|
| 1,559,246 | 10/1925 | Gilson | 336/67 |
| 1,628,398 | 5/1927 | Casper et al. | 336/210 X |
| 2,903,661 | 9/1959 | Goffstein | 336/65 |
| 3,110,873 | 11/1963 | Mittermaier | 336/210 |
| 3,371,301 | 2/1968 | Hisano | 336/210 X |
| 3,760,316 | 9/1973 | Czewski et al. | 336/210 |
| 3,766,643 | 10/1973 | Arrington et al. | 336/210 X |

FOREIGN PATENT DOCUMENTS

| | | | |
|---|---|---|---|
| 1056659 | 5/1939 | Fed. Rep. of Germany | 336/65 |
| 1409699 | 7/1965 | France | 336/65 |
| 1447932 | 6/1966 | France | 336/67 |

OTHER PUBLICATIONS

Siemens Data Book 1975/76, "Weichmagnetisches Siferritoid Sirufer-Material," pp. 372-378.

*Primary Examiner*—Thomas J. Kozma

*Attorney, Agent, or Firm*—Hill, Van Santen, Steadman, Chiara & Simpson

[57] ABSTRACT

A holder for an electromagneticcoil assembly comprised of joined mirror symmetric E core halves has two bracket pieces which are disposed adjacent to joined legs of the E core halves, each bracket having a pair of bores therein for receiving at least one retainer rod. The rod extends through the brackets and an alignment bore or groove in the core halves. In one embodiment of the holder a retainer plate having bores in registry with the bracket bores also receives the retainer rod, with nuts applied to threaded ends of the retainer rod to exert a uniform retaining pressure along opposite faces of the core halves to maintain a substantially constant core air gap and maximize vibration resistance.

10 Claims, 7 Drawing Figures

HOLDER FOR AN ELECTROMAGNETIC COIL

BACKGROUND OF THE INVENTION

1. Field of the Invention

The present invention relates to holders for electromagnetic coils, and in particular holders for coil assemblies having abutting mirror symmetric E core halves which receive and retain the coil winding.

2. Description of the Prior Art

A common method for constructing a core to receive an electromagnetic coil winding is that of joining opposed mirror symmetric E-shaped core halves with a coil winding holder inserted therebetween and retained thereby. Each E core half has opposed outer parallel legs forming the exterior surface of the complete core, as well as a centrally disposed center leg which receives the coil winding holder.

In connection with electromagnetic coils having small light weight E cores, of the type described, for example, in Siemens Data Book 1975/76 "Weichmagnetisches Siferrit- und Sirufer-Material", pages 372–378, it is known to use a spring bar as a holder for the coil unit comprised of the joined opposed E core halves with the coil winding held therebetween. For electromagnetic coils having larger and heavier E cores, it is known to utilize stronger leaf-springs to press the core halves together. The use of springs of this type results in an uneven application of pressure along the surfaces of the electromagnetic coil which can result in deviations in the air gap dimensions between the central legs of the E core halves which hold the coil windings. Such air gap deviations result in undesired changes in the electric and magnetic values of the coil which either require a constant monitoring of those values, or prevent utilization of the coil in certain applications.

Another holder is known in the art for use with E core halves having cylindrical central legs which consists of a U-shaped sheet metal frame and a cross arm which snaps into the frame. Retaining tension is supplied by an equalizer spring. This type of holder is not only very expensive, but is also mechanically unstable and is therefore unable to withstand vibration.

SUMMARY OF THE INVENTION

It is an object of the present invention to provide a holder for an electromagnetic coil assembly of the type constructed of abutting E core halves which retains the halves in abutting relation by the application of uniform pressure along opposite faces of the halves to maintain a substantially constant core air gap.

It is another object of the present invention to provide a holder for an electromagnetic coil which retains the coil in a manner which is highly resistant to vibration and further to provide such a holder which may also be used to mount the coil to a circuit board.

The above objects are inventively achieved in a holder comprised of two brackets which are disposed adjacent to abutting legs of the E core halves and which receive at least one retainer rod through bores therein to completely surround the joined E core halves and thereby exert uniform exterior pressure along opposite faces of the halves to achieve a substantially constant core air gap. The retainer rod is in one embodiment received in a retainer plate having bores therein in registry with the bores in the brackets. The free ends of the retainer rod are threaded to receive bolts to apply the uniform pressure.

Each bracket has at least one downwardly depending leg terminating in a right angle flange by which each bracket can be mounted to a circuit board. Each bracket thus not only serves to retain the coil assembly elements in a vibration resistant configuration, but also serves as a means for mounting the assembly to a circuit board.

In one embodiment of the invention the brackets are generally T-shaped and the crossbar of the T has ends which are bent at right angles to receive abutting legs of the E core halves. The vertical portion of the T terminates in a right angle bend for attachment to a circuit board. A U-shaped retainer rod is inserted in bores in registry with rod-receiving means in the core legs and is secured by nuts received on threaded ends of the rod to apply retaining pressure to the core halves.

In a second embodiment of the invention, the brackets each consist of a horizontal bridge piece having two downwardly depending legs which terminate in a right angle flange for attachment to a circuit board. In this embodiment, two retainer rods are utilized which have a first hooked end which is received in corresponding bores in one of the brackets, and a second threaded end which is received in bores in the other bracket and which receives a nut for exerting retaining pressure on E core halves disposed between the brackets.

DESCRIPTION OF THE PREFERRED EMBODIMENTS

Figure 1:
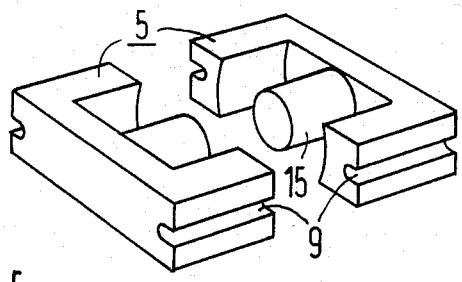
FIG. 1 is a perspective view of a mirror symmetric E core halves for an electromagnetic coil assembly.

Two mirror symmetric E core halves for an electromagnetic coil assembly are shown at 5 in FIG. 1. Each half has a central face portion from which external legs 5*a* extend so that when the halves are joined a generally square structure is formed. Each half 5 further has a centrally disposed cylindrical leg 15 which receives a bobbin for the coil winding. A groove 9 is carried on each leg 5*a* with the grooves being in registry so that when the halves 5 are joined a continuous groove is formed along opposite sides of the joined structure.

Figure 2:
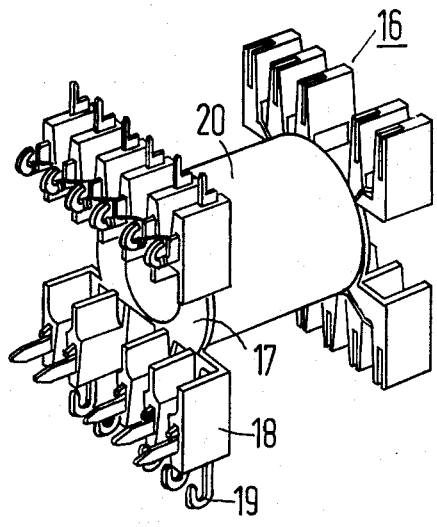
FIG. 2 is a perspective view of a bobbin for an electromagnetic coil assembly for holding the coil winding.

A bobbin for use in a coil assembly with the E core halves 5 of FIG. 1 is referenced generally at 16 in FIG. 2. The bobbin 16 consists of a hollow cylindrical holer 17 about which the coil 20 is wound. When assembled, the holder 17 is received by the cylindrical legs 15 of each E core half 5. The bobbin 16 further has a plurality of solder lug receptacles 18, each of which receives a force-fit solder lug 19 for connecting the coil to the other circuit components. The solder lugs 19 may be selectively connected to terminations of the coil windings as may be dictated by individual circuit requirements.

Figure 3:
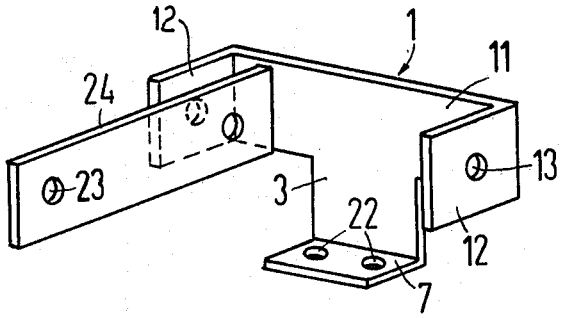
FIG. 3 is a persective view of a bracket and retainer plate for an electromagnetic coil holder constructed in accordance with the principles of the present invention.
Figure 3A:
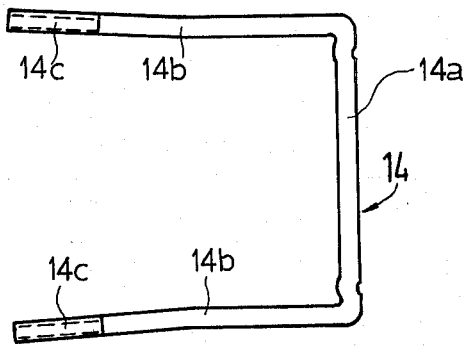
FIG. 3*a* is a plan view of a retainer rod for use with the bracket of FIG. 3.

Operative parts of a holder for retaining the E core halves 5 and the bobbin 16 as well as fastening the coil assembly to a chassis plate or circuit board are shown in FIGS. 3 and 3*a*. In FIG. 3, a T-shaped bracket is generally referenced at 1 comprising a crossbar 11 and a vertical leg 3. The ends of the crossbar 11 are bent at right angles to form retaining flanges 12. Each flange 12 has a bore 13 therein with the bores 13 being in registry.

The vertical leg 3 of the bracket 1 terminates in a right angle flange 7 which has a pair of holes 22 therein for attachment of the assembled coil structure to a circuit board.

The holder further comprises a retainer plate 24 which has holes 23 therein. The retainer plate 24 is of a length equal to the end face of one of the E core halves 5, so that when the holder is assembled the vertical edges of the plate 24 will abut the crossbar 11 with the holes 13 and 23 in alignment.

A retainer rod for use with the bracket and retainer plate of FIG. 3 is illustrated in FIG. 3*a* at 14. The rod 14 consists of a bridge portion 14*a* having generally parallel legs 14*b* extending therefrom which terminate in threaded ends 14*c*.

Figure 4:
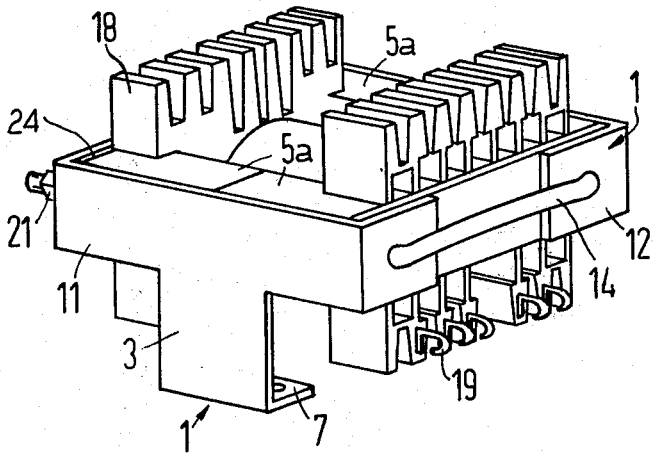
FIG. 4 is a perspective view of an electromagnetic coil assembly received in a holder constructed in accordance with the principles of the present invention.

A completed assembly of the coil elements within the holder is shown in FIG. 4. The respective crossbars 11 of each bracket 1 receive abutting legs 5*a* of each core half 5. The retainer rod 14 is inserted through the holes 13 in the brackets 1 and is guided within the grooves 9 in the E core halves 5 to extend through the other end of the bracket 1 where nuts 21 are threaded on the ends 14*c* to exert retaining pressure on the halves 5. The plate 24 is inserted between one flange 12 of each bracket 1 and the adjacent face of one of the E core halves 5. Retaining pressure is thus exerted along the entire face of each half 5 in a uniform manner so as to substantially minimize any changes in the air gap dimensions within the coil assembly, thereby insuring relatively constant electric and magnetic values associated with the coil asembly.

Figure 5:
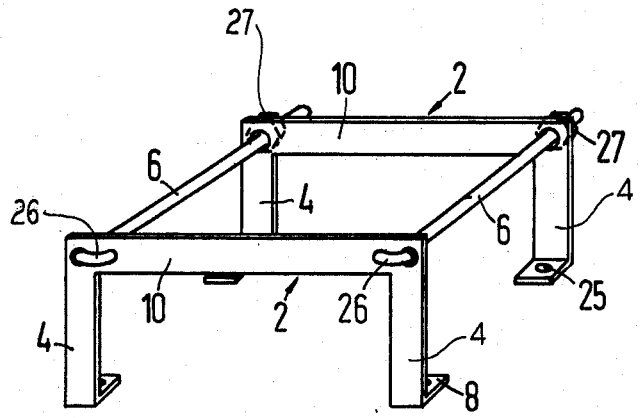
FIG. 5 is a second embodiment of the holder of FIG. 3 utilizing rectangular brackets.

A second embodiment of the holder is shown in FIG. 5 consisting of brackets referenced generally at 2 which are rectangular in shape consisting of a bridge portion 10 and two downwardly depending legs 4. Each leg 4 terminates in a right angle flange 8 which has a hole 25 therein for attaching the assembly to a circuit board. Although the U-shaped rod 14 shown in FIG. 3*a* may be utilized with the embodiment shown in FIG. 5, two separate retainer rods 6 may also be utilized. Each rod 6 has a first end terminating in a hook 26 received in a bracket 2, and has an opposite threaded end received in bores in the other bracket 2 and pressure is applied by nuts 27 to retain the core halves 5 between the brackets 2. Each rod 6 is received in the grooves 9 in the legs 5*a* of the E core halves 5. It will also be understood that the separate retainer rods 6 may be utilized in the embodiment of FIG. 4 in place of the U-shaped retainer rod 14, in which case the flanges 12 may be eliminated and the holes 13 disposed directly on the crossbar 11.

Figure 1A:
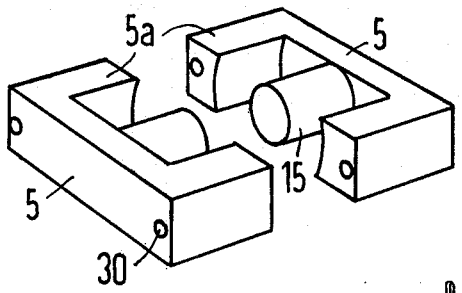
FIG. 1*a* is a perspective view of the assembly of FIG. 1 utilizing bores in place of grooves.

It will also be apparent to those skilled in the art, as shown in FIG. 1*a*, that each leg 5*a* of the core halves 5 may be provided with a bore 30 in alignment with a bore in the abutting leg of the other core half in place of the grooves 9, which bores would then serve to guide the retainer rod 14 or 6 in the assembled holder.

Although other modifications and changes may be suggested by those skilled in the art, it is the intention of the inventors to embody within the patent warranted hereon all changes and modifications as reasonably and properly come within the scope of their contribution to the art.

We claim as our invention:

1. In an electromagnetic coil assembly consisting of opposed abutting E core halves each having an end face and two outer legs and a centrally disposed inner leg, and a hollow coil bobbin which receives said central legs and is disposed between said halves, a holder for said assembly comprising:

two brackets disposed adjacent to said outer legs of each core half, each said bracket having a pair of spaced bores;

at least one retainer received in said bores in said brackets, said retainer terminating in two threaded ends;

a means in said E core half legs for receiving and aligning said retainer, whereby said retainer extends through said brackets and said means in said core half legs to hold said halves between said brackets;

a pair of nuts received on said threaded ends of said retainer for applying uniform retaining pressure to said halves in cooperation with said brackets; and at least one vertical leg respectively depending downwardly from each bracket, each said vertical leg carrying means thereon for attaching said vertical leg to a circuit.

2. The holder of claim 1 wherein said means in said E core half legs for receiving and aligning said retainer are aligned bores extending through said legs.

3. The holder of claim 1 wherein said means in said E core half legs for receiving and aligning said retainer are grooves carried on the outer surfaces of said legs.

4. The holder of claim 1 wherein said bracket consists of a central bridge portion having two bracket legs downwardly extending therefrom.

5. The holder of claim 1 wherein said bracket is T-shaped having a crossbar carrying said bores in said bracket, and having a vertical portion forming said vertical leg.

6. The holder of claim 5 wherein said crossbar terminates in two right angle flanges which surround and receive corners of said E core halves.

7. The holder of claim 1 wherein said retainer is a U-shaped rod having a central bridge portion from which two parallel legs respectively terminating in said threaded ends extend at right angles.

8. The holder of claim 1 wherein said retainer is a pair of rods each having a first hooked end received in one of the bores of one of said brackets and each having at an opposite end one of said threaded ends which is received in one of the bores of the other bracket with said E core halves retained between said brackets.

9. The holder of claim 1 wherein said means for attaching said vertical leg to a circuit board is a right angle flange carried at a lowest portion of said vertical leg, said flange having at least one hole therein for receiving a mounting bolt.

10. The holder of claim 1 wherein a retaining plate is disposed between a face of one of said E core halves and a bracket closest to said face, said retaining plate having a pair of spaced bores therein in registry with the bores in said bracket for receiving the threaded ends of said retainer.

* * * * *